United States Patent [19]

Kitchen et al.

[11] 4,120,058

[45] Oct. 17, 1978

[54] LOW PROFILE BOX SPRING ASSEMBLY

[75] Inventors: John P. Kitchen, Georgetown, Ky.; Jack C. Mandusky, Adrian, Mich.

[73] Assignee: Hoover Universal, Inc., Saline, Mich.

[21] Appl. No.: 824,347

[22] Filed: Aug. 15, 1977

[51] Int. Cl.[2] ..... A47C 23/02

[52] U.S. Cl. ..... 5/247; 5/255; 5/263; 267/103

[58] Field of Search ..... 5/247, 256, 263, 264 R, 5/264 B, 351; 267/103, 107

[56] References Cited

U.S. PATENT DOCUMENTS

| | | | |
|---|---|---|---|
| 3,574,241 | 4/1971 | Slominski | 5/247 |
| 3,722,013 | 3/1973 | Surletta | 5/247 |
| 3,835,485 | 9/1974 | Klicki | 5/255 |

*Primary Examiner*—Casmir A. Nunberg
*Attorney, Agent, or Firm*—Olsen and Stephenson

[57] ABSTRACT

A box spring assembly is disclosed in which a plurality of main wire springs and intermediate wire springs are mounted on a generally rectangular frame. Each wire spring has a generally straight body portion and relatively short depending end portions, each of which is formed to a generally fish-mouth configuration. The end portions are secured to the frame and provide a substantial resistance to downwardly directed loads.

2 Claims, 4 Drawing Figures

FIG. 2
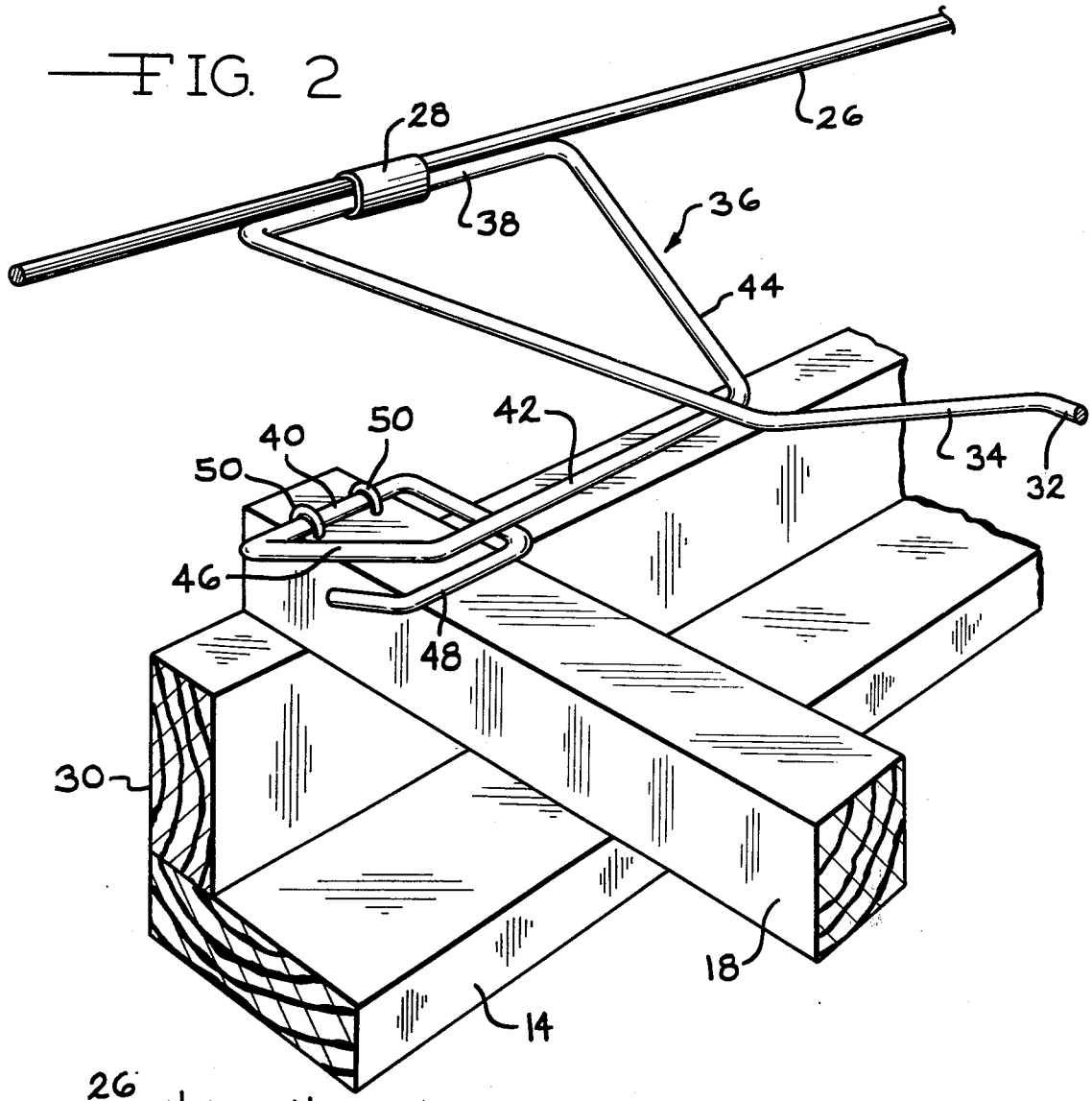
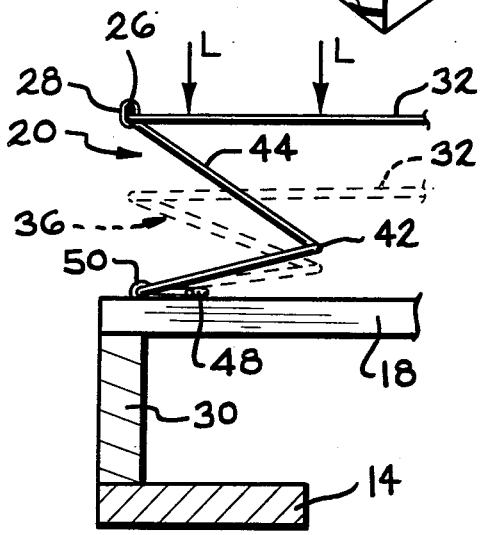
FIG. 3
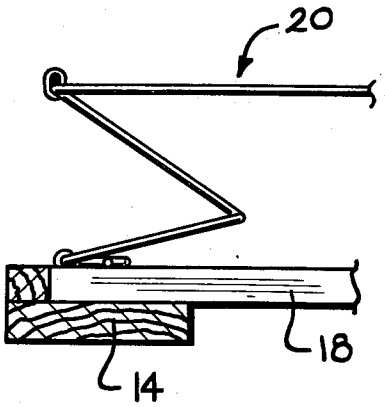
FIG. 4

LOW PROFILE BOX SPRING ASSEMBLY

BACKGROUND OF THE INVENTION

The present invention relates generally to a box spring assembly using formed wire springs to support a mattress, and more particularly to an improved box spring assembly of low profile construction having an improved feeling of firmness. Formed wire springs are often used in box spring assemblies as illustrated in U.S. Pat. Nos. 3,286,281; 3,487,480; 3,574,241; 3,665,529; and 3,852,838, all of which are assigned to the assignee of the present application. Although box spring assemblies using formed wire springs such as those disclosed in the above applications are generally understood to offer a firm foundation, greater and greater firmness is becoming associated in the public mind with quality bedding. The increased demand for firm support bedding has arisen because of the widespread belief that beds which offer firm support are advantageous from the standpoints of being more comfortable and physically beneficial to the user. The desired firmness can be achieved in some instances by increasing the size of the wires which constitute the box spring assembly, but that necessitates an increase in the weight of the box spring assembly and an increase in the cost of its manufacture. There is a need, therefore, for a box spring assembly having formed wire springs which provide a firm support to the user and which can be manufactured from a minimum amount of material. It is also desirable to construct these formed wire springs with a low profile, namely, relatively short vertical height, so as to facilitate the construction of box spring assemblies having a variety of heights without changing the construction of the formed wire spring.

It is an object of the present invention, therefore, to provide an improved low profile formed wire box spring assembly that offers increased resistance to downwardly directed loads.

SUMMARY OF THE INVENTION

In accordance with the present invention, a box spring assembly is provided having main wire springs mounted on a generally rectangular frame. The main springs extend longitudinally and transversely of the frame with each spring being formed of a generally straight body portion having depending end portions formed to a generally "fish-mouth" configuration. The end portions are mounted on the frame and provide firm resistance to downwardly directed bedding loads. The intermediate springs are located between the transversely and longitudinally extending wire springs and are formed having a main body portion with depending end portions having a fish-mouth configuration which generally corresponds with the configuration of the end portions of the main wire springs.

Each end portion comprises three vertically spaced torsion bars and a pair of inclined connecting bars connected to the torsion bars in a generally fish-mouth configuration. The bottom torsion bar is positioned on the frame and is provided with a generally L-shaped mounting foot that engages the frame inwardly of the bottom torsion bar to provide the necessary support for the wire spring. The top torsion bar is parallel to and located in generally vertical alignment with the bottom torsion bar and the intermediate torsion bar is located inwardly of the top and bottom torsion bars. One of the connecting bars extends upwardly and outwardly from the intermediate torsion bar and is connected to the upper torsion bar and the other connecting bar extends downwardly and outwardly from the intermediate torsion bar and is connected to the bottom torsion bar thereby providing the end portion with the fish-mouth formation. When a load is applied to the box spring assembly, the springs are deflected causing the torsion bars to twist thereby providing the resistance to the downwardly directed load.

The low height of the springs enables the construction of a box spring assembly of low or standard height, whichever is desired. When a standard height is desired, height adjusting rails are incorporated in the box spring frame.

Further objects, features and advantages of the present invention will become apparent from a consideration of the following description when taken in connection with the appended claims and the accompanying drawing in which:

FIG. 2 is a fragmentary perspective view of a portion of the box spring assembly shown in FIG. 1;

FIG. 3 is a fragmentary sectional view of a portion of the box spring assembly of this invention as seen from substantially the line 3 — 3 in FIG. 1; and FIG. 4 is a sectional view like FIG. 3, but showing the wire spring mounted on a modified frame.

Figure 1:
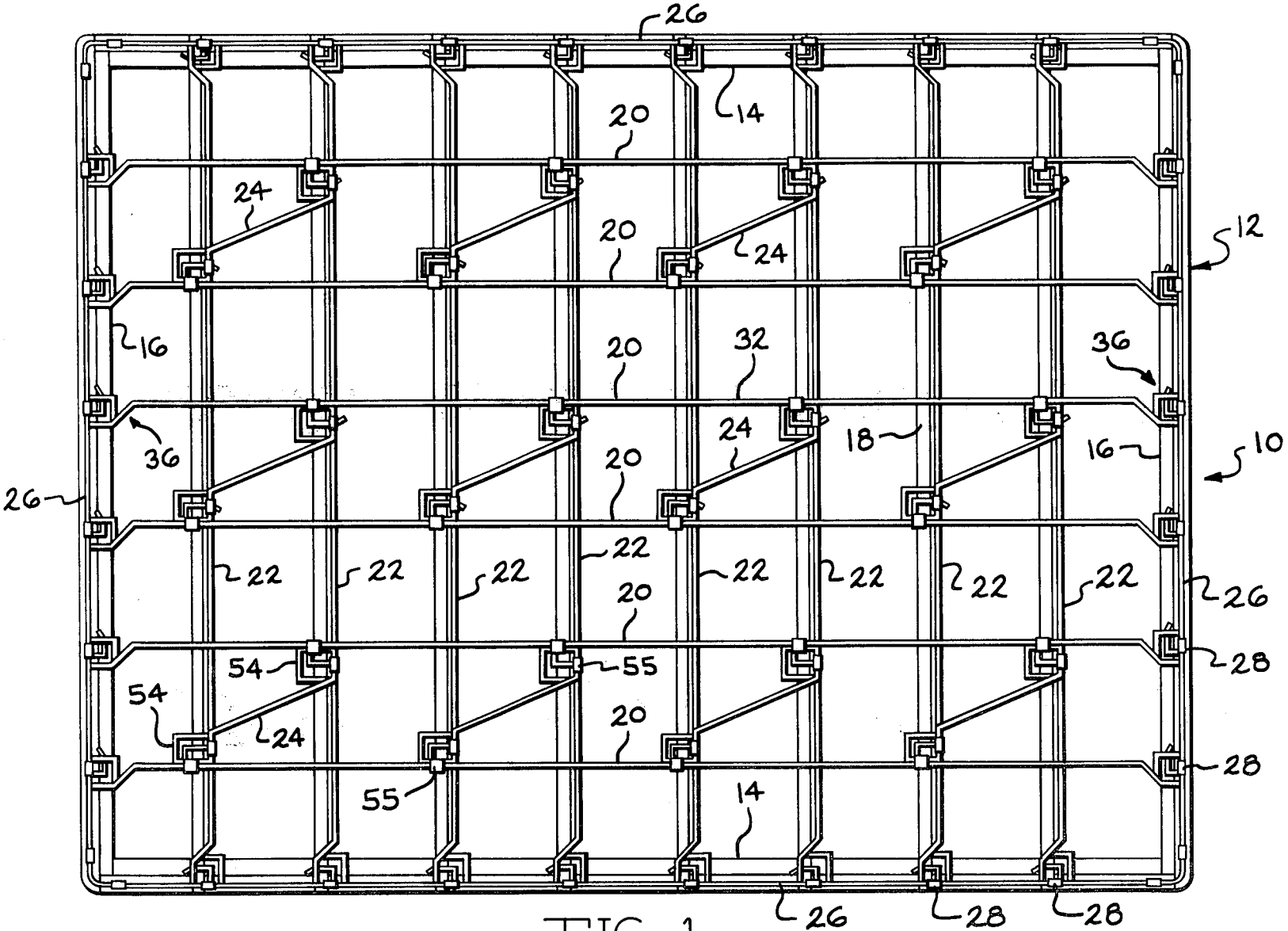
FIG. 1 is a plan view of the box spring assembly of this invention.

With reference to the drawing, the box spring assembly of the present invention, indicated generally at 10, is illustrated in FIG. 1 as including a generally rectangular frame 12 having side rails 14 and end rails 16 connected to the side rails 14. A plurality of cross rails 18 are mounted on the side rails 14 in horizontally spaced positions parallel to the end rails 16. A plurality of main springs 20 extending generally lengthwise of the frame 12 and a plurality of main springs 22 extending transversely of the frame 12 are mounted on the frame 12 and together form a horizontally disposed load supporting wire grid for a mattress.

A plurality of intermediate support springs 24, twelve being illustrated in FIG. 1, are connected to the main springs 20 and 22 and mounted on the cross rails 18. A border wire 26 extends about the perimeter of the frame 12 and is connected to the main springs 20 and 22 by means of wrap-around spring clips 28. The intermediate support springs 24 are also secured to the main springs 20 and 22 by the wrap-around spring clips 28.

As illustrated in FIG. 2, the side rails 14 support auxiliary side rails 30 on which the cross rails 18 are mounted. Each auxiliary side rail 30 functions as a height adjusting rail for the box spring assembly 10 enabling a desired height for the box spring assembly 10 to be achieved. Since the springs 20 and 22 are of a low-profile construction, a desired height for the box spring assembly 10 can readily be achieved by using rails 30 of the correct height. The rails 30 can also be eliminated from the assembly 10, as shown in FIG. 4, so as to provide an assembly 10 a minimum height when this is desired.

The main springs 20 and 22 are substantially identical, differing only in length, each including a generally straight main body portion 32, an off-set portion 34 and depending end portions 36. Each depending end portion 36 comprises three torsion bars, a top torsion bar 38, a bottom torsion bar 40 that is parallel to and in substantial vertical alignment with the top torsion bar 38 and an intermediate torsion bar 42 positioned inwardly of and between the torsion bars 38 and 40. The intermediate torsion bar 42 is connected at its ends to the torsion bars 38 and 40 by means of connecting bars 44 and 46, respectively. The connecting bar 44 is inclined upwardly and outwardly from the intermediate torsion bar 42 toward the top torsion bar 38 and the other connecting bar 46 is inclined downwardly and outwardly from the intermediate torsion bar 42 toward the bottom torsion bar 40. A pair of staples 50 secure the torsion bar 40 and therefore the spring 20 to the cross rail 18 that is supported by the side rails 14.

As shown in FIG. 3, the arrangement of the connecting bars 44 and 46 with the intermediate torsion bar 42 provides the depending end portion 36 with a generally fish-mouth shape. This construction of the spring end portions 36 imparts the requisite stiffness to the springs in the assembly 10 to enable the assembly 10 to give the user a feeling of firm support for bedding loads, indicated at L. An L-shaped foot 48 is connected to the bottom torsion bar 40 and engages the cross rail 18 inwardly of the torsion bar 40 thereby enabling the torsion bar 40 to resistively twist in response to downwardly directed loads on the end portion 36.

The intermediate support springs 24 are suitably mounted on the cross rails 18 and include main body portions 52 and depending end portions 54 substantially identical to the end portions 36. The springs 24 serve to provide support for the main body portions 32 of the main springs 20 and 22 and are positioned so that the body portions 52 extend diagonally between adjacent springs 20 and also diagonally between adjacent springs 22. The depending end portions 54 are connected to the main springs 20 and 22 by means of wrap-around clips 55. In all other respects, however, the construction of the end portion 54 of the intermediate springs 24 is identical to the construction of the end portions 36 of the main springs 20.

In the use of the box spring assembly 10, the frame 12 is supported on a suitable bed frame and a mattress is then positioned on top of the box spring assembly 10 which is covered with the usual padding and fabric (not shown). In response to downwardly directed bedding loads, represented by the arrows L in FIG. 3, the end portions 36 are deflected so that the torsion bars 38 and 40 are moved downwardly as indicated in broken lines in FIG. 3. The yieldable twisting resistance offered by the torsion bars 38, 40 and 42 to the downwardly directed loads provides the desired firm support for the mattress and its occupant. The load is divided between the torsion bars 38, 40 and 42 so that none will be twisted beyond its elastic limit, the limited number of torsion bars being one of the factors contributing to the firmness of the assembly 10.

From the above description, it is seen that this invention provides an improved box spring assembly 10 capable of providing firm support to the user. The low profile springs, formed of a minimum amount of material, provide the desired firm support. The low profile construction of the springs enables the height of the box spring assembly 10 to be varied easily without requiring alteration of the construction of the springs.

What is claimed:

1. In a formed wire box spring assembly which includes a horizontally disposed generally rectangular frame and a plurality of formed wire springs mounted on said frame and extending upwardly therefrom, each of said springs comprising a unitary wire body member having a generally horizontal load supporting portion and yieldable end portions depending from the ends of said load supporting portion, each of said end portions comprising three vertically spaced torsion bars and a pair of inclined connecting bars arranged in a fish-mouth formation, the bottom one of said torsion bars being positioned on said frame, a mounting foot integral with said bottom torsion bar and engaged with said frame inwardly thereof from said bottom torsion bar, the top one of said torsion bars being located at one end of said load supporting portion and being generally parallel and in vertical alignment with said lower torsion bar, the intermediate one of said torsion bars being located inwardly of said frame from said top one of said torsion bars, one of said connecting bars extending from one end of said intermediate torsion bar to the corresponding end of said upper torsion bar and the other one of said connecting bars extending from the opposite end of said intermediate torsion bar to the corresponding end of said bottom torsion bar, said intermediate torsion bar being positioned between said top and bottom torsion bars so that said one connecting bar extends upwardly and outwardly from said intermediate torsion bar and said other connecting bar extends downwardly and outwardly from said intermediate torsion bar.

2. The structure according to claim 1 wherein said frame includes substantially co-planar side and end rails, upwardly extending height adjusting rails for said box spring assembly mounted on and extending upwardly from said side rails a predetermined distance, and cross rails arranged in a direct supporting relation with said spring mounting feet, said cross rails being mounted on the upper edges of said height adjusting rails and extending therebetween.

* * * * *